US006920864B1

(12) United States Patent
Roche et al.

(10) Patent No.: US 6,920,864 B1
(45) Date of Patent: Jul. 26, 2005

(54) THROTTLE BODY

(75) Inventors: Bradley J. Roche, Cass City, MI (US); Ronald H. Roche, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 42 days.

(21) Appl. No.: 10/635,160

(22) Filed: Aug. 6, 2003

(51) Int. Cl.[7] ..... F02D 9/14
(52) U.S. Cl. ..... 123/337; 251/212; 261/44.3
(58) Field of Search ..... 123/336, 337, 123/472; 251/212, 250; 261/44.3, 65

(56) References Cited

U.S. PATENT DOCUMENTS

| | | | | |
|---|---|---|---|---|
| 1,165,224 A | * | 12/1915 | Cadett | 261/65 |
| 3,822,058 A | * | 7/1974 | Carter | 261/44.3 |
| 4,097,562 A | * | 6/1978 | Blakeway | 261/44.3 |
| 4,257,379 A | * | 3/1981 | Hickling | 261/44.3 |
| 4,524,034 A | * | 6/1985 | Ellison | 261/44.3 |
| 5,275,375 A | * | 1/1994 | Semence | 251/308 |
| 5,341,773 A | * | 8/1994 | Schulte et al. | 123/184.61 |

FOREIGN PATENT DOCUMENTS

| | | | |
|---|---|---|---|
| DE | 2714933 | * | 10/1978 |
| DE | 3434696 | * | 4/1986 |
| JP | 4-183941 | * | 6/1992 |
| JP | 5-10159 | * | 1/1993 |

* cited by examiner

*Primary Examiner*—Tony M. Argenbright
(74) *Attorney, Agent, or Firm*—Reising, Ethington, Barnes, Kisselle, P.C.

(57) ABSTRACT

A throttle body for an internal combustion engine has a housing, a first plate carried by the housing for linear reciprocation between a first position and a second position in response to movement of a throttle member, and a second plate carried by the housing for linear reciprocation between a first position and a second position in response to the movement of the fist plate. The first plate and second plates define at least in part an opening through the throttle body. The opening provides a variable flow area that increases as the first plate and the second plate move from their first positions toward their second positions and decreases as the first and second plates move from their second positions toward their first positions. As the first and second plates move between their first and second positions, the flow area of the opening is continually varied.

20 Claims, 5 Drawing Sheets

THROTTLE BODY

FIELD OF THE INVENTION

This invention relates generally to throttle bodies for internal combustion engines, and more particularly to a mechanism for controlling the air flow through the throttle body.

BACKGROUND OF THE INVENTION

Internal combustion engines having fuel injectors typically incorporate a throttle body for controlling the air flow into the engine. By controlling the amount of air flow through the throttle body, the fuel-to-air mixture can be adjusted, and thus, the running performance of the engine can be controlled. Typically, a throttle body allows a relatively low flow rate of air to pass therethrough when the engine is idling, and allows an increased flow rate of air to pass therethrough during wide open or full throttle engine operation.

It is known to incorporate a "butterfly" type valve within a throat of a throttle body to control the amount of air flow therethrough. Generally, the butterfly valve pivots or rotates with a shaft between an idle position substantially restricting air flow through the throttle body and a wide open position permitting increased air flow through the throttle body. Even when the butterfly valve is in the wide open position, the valve occupies at least a portion of the air passage or throat of the throttle body. As a result, the valve provides some restriction to air flow through the air passage or throat at all times.

It is also known to have a sensor communicating with a throttle body to detect the position of the butterfly valve within the throttle body. The sensor typically communicates with an engine control unit (ECU) so that the ECU can determine and control adjustments within the engine to optimize the running performance of the engine. Typically, the sensor is an intricate rotary style sensor that is unique in design for the given application. As a result, both in manufacture and in service, the sensors are relatively costly.

SUMMARY OF THE INVENTION

A throttle body for an internal combustion engine has a housing, a first plate carried by the housing for linear reciprocation between a first position and a second position in response to movement of a throttle member, and a second plate carried by the housing for linear reciprocation between a first position and a second position in response to the movement of the first plate. The first plate and second plate define at least in part an opening through the throttle body with a variable flow area that increases as the first plate and the second plate move from their first positions toward their second positions. Preferably, at idle engine operation the first and second plates are in their first positions wherein the opening has its minimum flow area. At wide open throttle engine operation, the first and second plates are moved to their second positions wherein the opening has its maximum flow area to permit increased air flow to the engine. As the first and second plates move between their first and second positions, the flow area of the opening is continually varied.

Objects, features and advantages of this invention include a throttle body providing a variable air flow area through the throttle body, a throttle body that is relatively lightweight, a throttle body having a position sensor that is both economical and adaptable to a variety of engine designs, is of relatively simple design and economical manufacture, can be arranged for either a hose or flange type mount, and facilitates serviceability and assembly.

BRIEF DESCRIPTION OF THE DRAWINGS

These and other objects, features and advantages of this invention will be apparent from the following detailed description of the preferred embodiments and best mode, appended. claims and accompanying drawings in which:

DETAILED DESCRIPTION OF THE PREFERRED EMBODIMENTS

Figure 1:
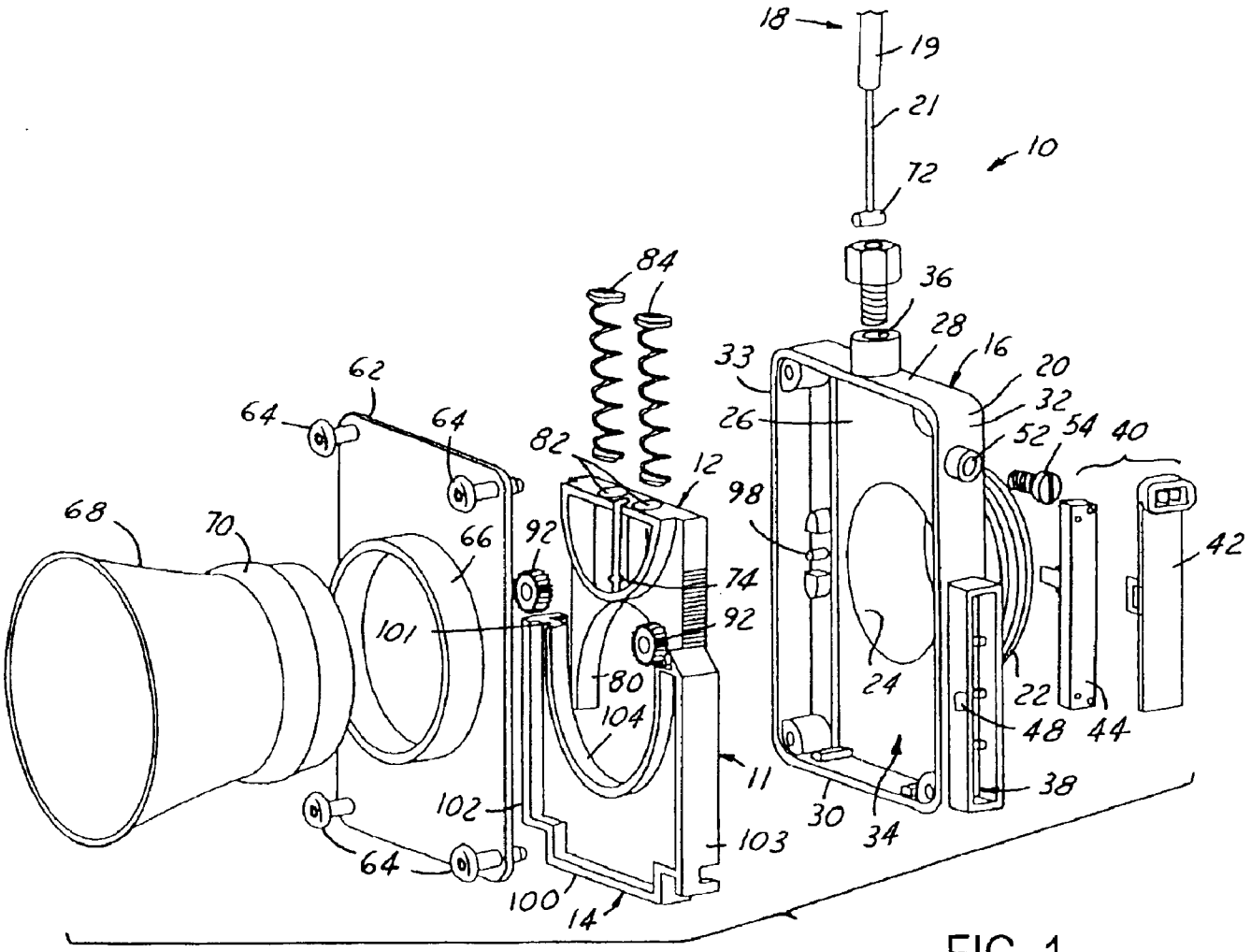
FIG. 1 is an exploded perspective view of a throttle body constructed according to one presently preferred embodiment of the invention.
Figure 2:
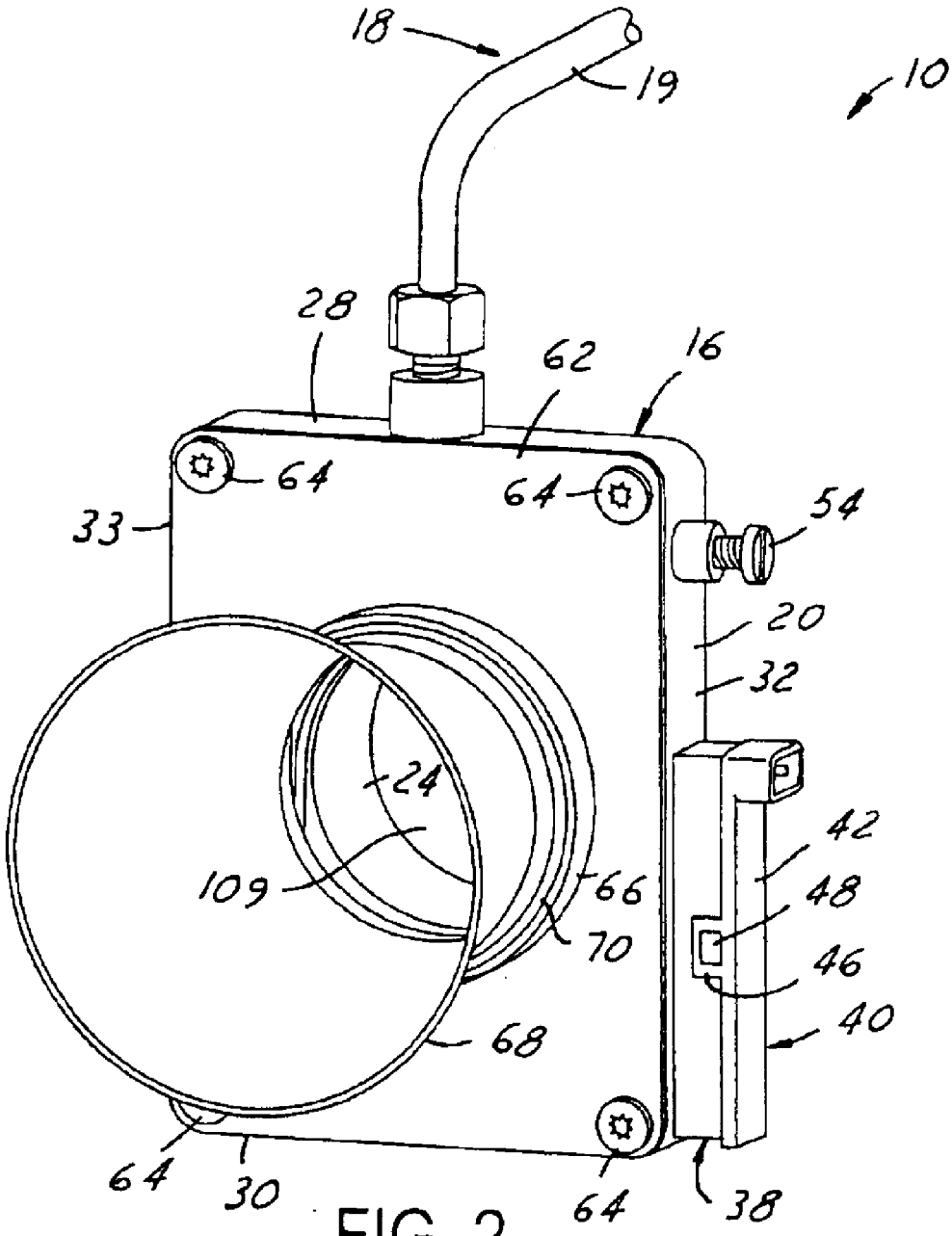
FIG. 2 is a front perspective view of the throttle body of FIG. 1.
Figure 3:
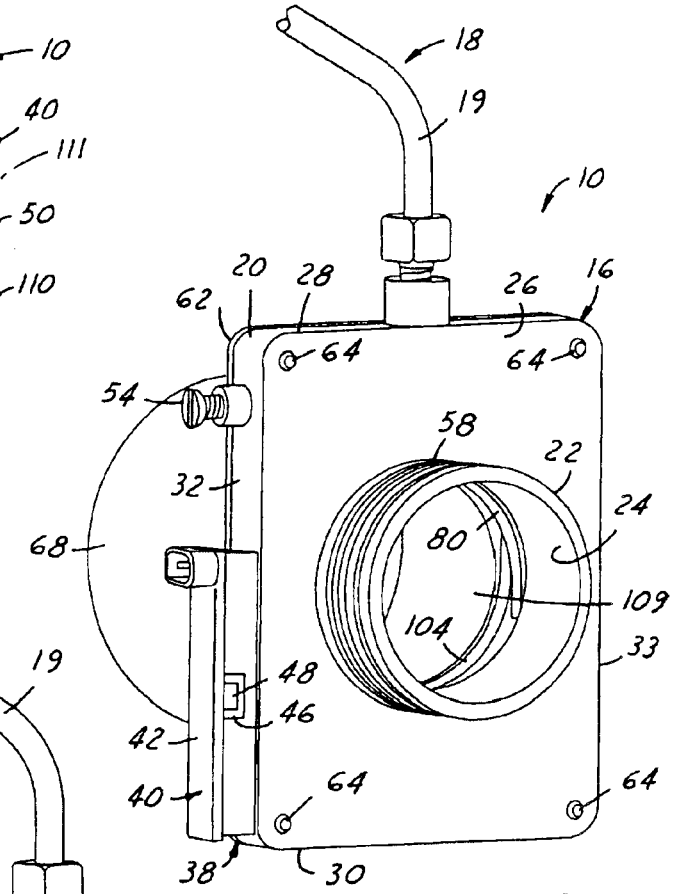
FIG. 3 is a rear perspective view of the throttle body of FIG. 1.
Figure 4:
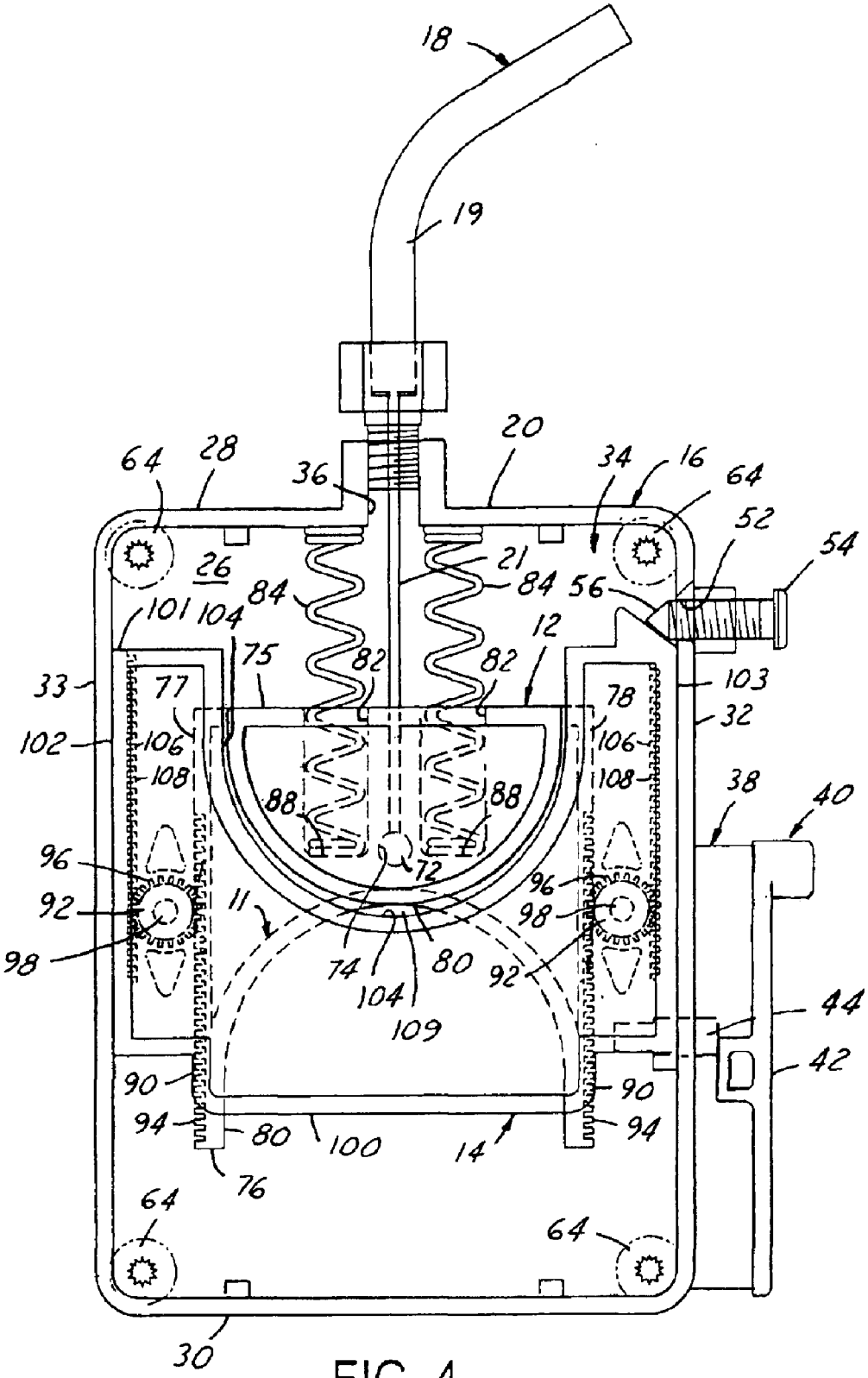
FIG. 4 is a front view of the throttle body with a cover removed showing a throttle valve in an idle position.
Figure 5:
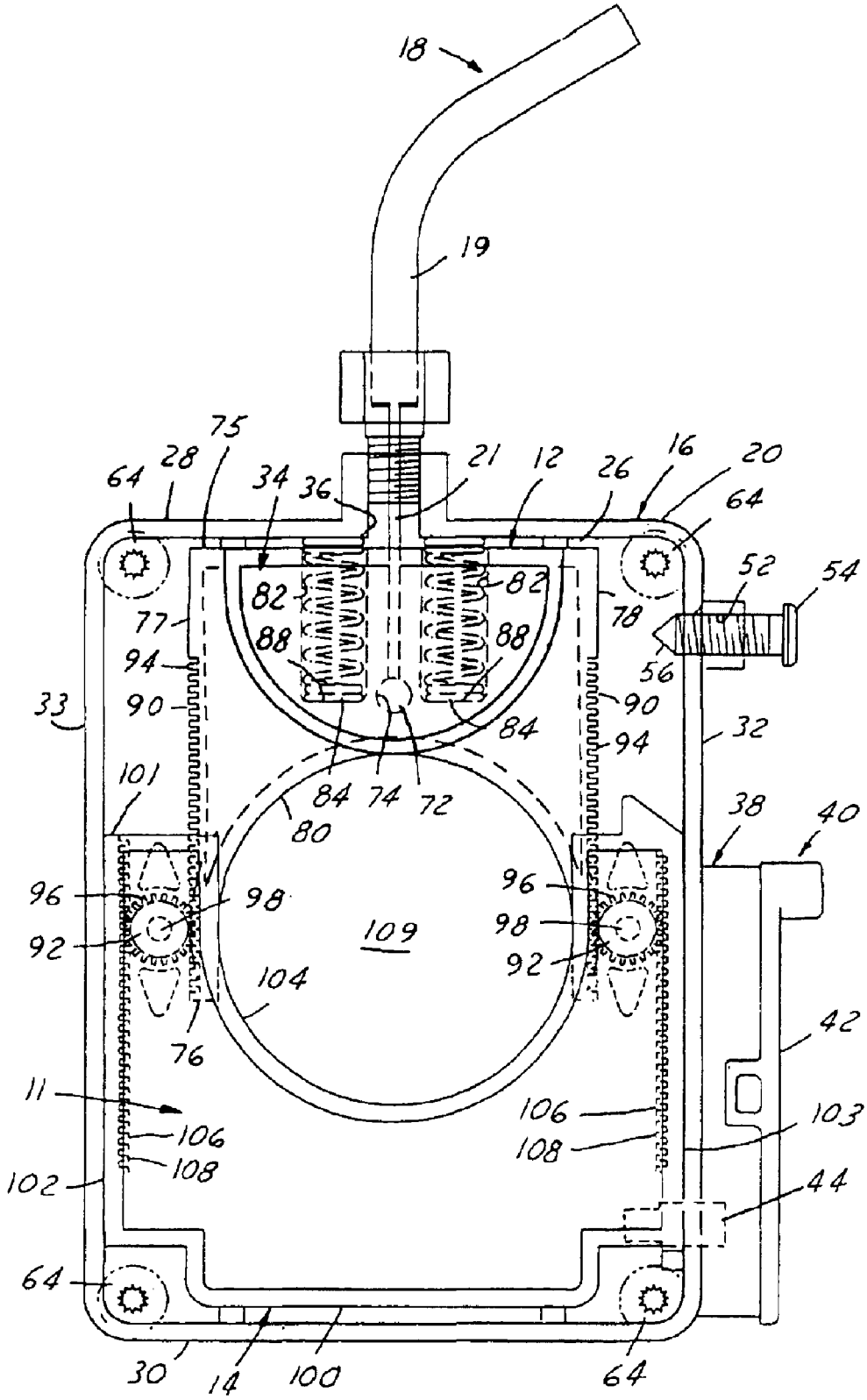
FIG. 5 is a view similar to FIG. 4 showing the throttle valve in a wide open position.

Referring in more detail to the drawings, FIGS. 1–5 illustrate one presently preferred embodiment of a throttle body 10. As best shown in FIGS. 1, 4 and 5, the throttle body 10 has a housing 16 and a throttle valve 11 including a first plate 12 and a second plate 14. Both plates 12, 14 are received for linear reciprocation or movement between first and second positions defining idle and wide open positions of the throttle valve 11, respectively. The first plate 12 moves from its first position to its second position in response to movement of a throttle member, represented here as a throttle cable 18. The second plate 14 moves from its first position to its second position in response to the first plate 12 moving from its first position to its second position.

As shown in FIGS. 1 and 3, the housing 16 has a main body 20 with a generally cylindrical snout 22 extending outwardly therefrom. The snout 22 defines at least in part an air passage 24 in the throttle body 10. The main body 20 has an end wall 26 extending generally transversely from the snout 22. Extending from the end wall 26 is an upper wall 28, a lower wall 30, and a pair of side walls 32, 33 extending between the upper and lower walls 28, 30 to define a cavity 34 in which the first and second plates 12, 14 are received for linear movement. Preferably, one of the side walls 32 has an electrical connector 38, either formed integrally with or attached thereon, that enables attachment, at least in part, of a potentiometer 40, discussed in more detail hereafter.

Preferably, the upper wall 28 has an opening 36 for receiving the throttle cable 18 therethrough for attachment to the first plate 12. The throttle cable 18 is preferably attached to a throttle lever (not shown) that is movable between an idle position and a wide open position, for example and without limitation, a throttle lever on a snowmobile or motorcycle. The throttle cable 18 includes an outer sheath 19 and an inner cable 21 that is retracted and extended in response to movement of the throttle lever. To facilitate attachment of the inner cable 21 to the first plate, the inner cable 21 preferably terminates in an enlarged end 72.

Figure 6:
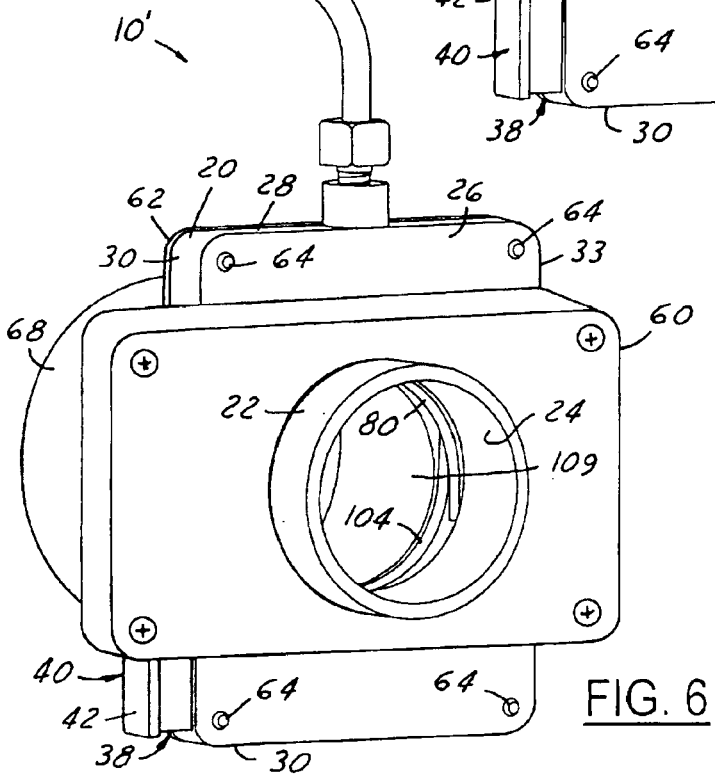
FIG. 6 is a rear perspective view of a second embodiment of a throttle body.

The snout 22 of the housing 16 is operably attached to the engine and provides air flow into the engine. The snout 22 can be arranged for a hose connection to the engine as best shown in FIG. 3, or for a flange connection, as shown in FIG. 6. With a hose connection, sometimes referred to as a "spud" connection, hose clamps (not shown) are typically arranged around a hose (not shown) to clamp the hose about an outer surface 58 of the snout 22. As shown in FIG. 6, an alternate embodiment of a throttle body 10' has a housing with a flange 60 arranged for direct connection to the engine. Here, the flange 60 is represented as having a four-hole bolt pattern, though it should be recognized that any suitable bolt pattern or other fasteners may be used.

The housing 16 has a cover 62 that is attached to the main body 20, such as by standard threaded fasteners 64, to enclose at least in part the cavity 34. The cover 62 preferably has a generally cylindrical flange 66 extending laterally outwardly therefrom for receiving an air inlet cone or funnel 68 of the throttle body 10. The funnel 68 preferably has a circumferential ridge 70 to facilitate locating the funnel 68 as it is inserted into the flange 66. The funnel 68 can have an interference fit within the flange, or it can be retained by any known method, such as a set screw (not shown) or the like.

The first plate 12 is received within the cavity 34 generally between the end wall 26 and the cover 62. As shown in FIGS. 1, 4 and 5, the first plate 12 has a recess 74 that receives the enlarged end 72 of the inner wire 21 of the throttle cable 18 so that the first plate 12 is moved linearly within the housing 16 in response to movement of the inner wire 21. As shown in FIGS. 4 and 5, the first plate 12 has a pair of generally opposed ends 75, 76 with a pair of sidewalls 77, 78 extending there between. One end 76 has a recessed surface 80 presenting a generally arcuate, and shown here as a generally semi-circular leading edge. The other end 75 preferably has at least one, and as shown here a pair of pockets 82 for receiving, at least in part, a pair of springs 84. The springs 84 are compressed between the upper wall 28 of the housing 16 and a bottom surface 88 of the pockets 82 to yieldably bias the first plate 12 toward the lower wall 30.

The sidewalls 77, 78 of the first plate 12 present surfaces 90 for mating engagement with a pair of pinions, referred to hereafter as pinion gears 92. The surfaces 90 are shown here as including toothed racks 94 for mating engagement with the teeth 96 of the pinion gears 92. The pinion gears 92 are preferably journalled for rotation on axles or pins 98 extending laterally from the wall 26 of the housing. The pins 98 can be formed as one piece with the housing 16, or can be separately attached thereto.

The second plate 14 has a pair of generally opposed ends 100, 101 with a pair of sidewalls 102, 103 extending therebetween. One of the ends 101 has a recessed surface 104 presenting a generally arcuate, and shown here as semi-circular, leading edge. The sidewalls 102, 103 of the second plate 14 present surfaces 106 for mating engagement with the pinion gears 92. The surfaces 106 are shown here including toothed racks 108 for mating engagement with the teeth 96 of the pinion gears 92 at a generally diametrically opposed location from where the racks 94 of the first plate 12 engage the pinion gears 92. The leading edge of the second plate 14 is generally opposed and faces the leading edge of the first plate 12 to define, at least in part, an opening 109 between the first and second plates 12, 14. As discussed in more detail below, the flow area of the opening 109 increases as the first and second plates 12, 14 move from their first positions toward their second positions.

As shown in FIG. 4, when the first and second plates 12, 14 are in their first positions, the opening 109 has its minimum size or flow area. As shown in FIG. 5, when the first and second plates 12, 14 are in their second positions, the opening 109 has its maximum size or flow area. The plates 12, 14 are moved between their first and second positions by actuation of the throttle cable 18.

Movement of the first plate 12 due to displacement of the inner wire 21 of the throttle cable 18 causes the pinion gears 92 to rotate about their respective axis of rotation, thus causing proportional movement of the second plate 14. Accordingly, as the first plate 12 moves away from its first position, the second plate 14 moves away from its first position and thus, away from the first plate 12. In this direction of movement of the plates 12, 14, the flow area of the opening 109 increases as the plates 12, 14 move away from each other. When the first plate 12 moves toward its first position, the second plate 14 is caused to move toward its first position, and thus toward the first plate 12, thereby decreasing the flow area of the opening 109. Therefore, movement of the first plate 12 and second plate 14 from their first positions or idle positions to their second positions or wide open positions continually varies the flow area of the opening 109 to vary the flow rate of air that may pass through the opening 109 for delivery to the engine.

Figure 7:
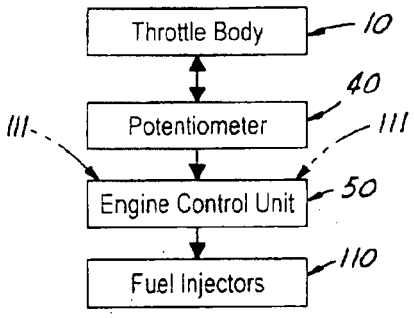
FIG. 7 is a schematic diagram showing a sensor operatively communicating between the throttle body and an engine.

To facilitate monitoring the positions of the plates 12, 14, and to improve the overall performance of the engine, the potentiometer 40 has a stationary component 42 that remains statically positioned on the side wall 32 of the housing 16, and a slidable component 44 that is responsive to movement of and preferably attached to one of the plates 12, 14, and is shown here attached to the second plate 14. Preferably, the stationary component 42 has at least one tab 46, and as shown has a pair of hoop tabs 46, providing a snap-on attachment to a pair of tabs 48 extending from the electrical connector 38. As the second plate 14 moves in response to movement of the first plate 12, the potentiometer 40 is able to detect the instantaneous position of the second plate 14, and produce an electric signal indicative of this position which is communicated to an engine control unit 50 (ECU), as shown in FIG. 7. The ECU 50 in turn is able to calculate or determine and control adjustments of the engine (not shown) so that the engine operates at its maximum efficiency and potential. The potentiometer 40 is represented here as a linear potentiometer, and thus is of relatively simple and economical design. The linear potentiometer 40 is well suited for use within a variety of sizes of throttle bodies, and thus is widely adaptable to a variety of different engine sizes and applications. It should be recognized that the potentiometer 40 can be arranged other than as shown here, for example and without limitation, the slidable component could be attached to or associated with the first plate 12, or a rotary potentiometer driven by a pinion gear meshed with one of the racks 94, 108 could be utilized.

Preferably, one of the sides 103 of the second plate 14 is arranged to receive the slidable portion 44 of the potentiometer 40 that moves or slides relative to the static portion 42 of the potentiometer 40. Accordingly, as the second plate 14 moves in response to the movement of the first plate 12, the position of the second plate 14 within the housing 16 can be detected via the potentiometer 40. As shown in FIG. 7, with the potentiometer 40 detecting the position of the second plate 14, and thus the first plate 12, an electric signal is communicated from the potentiometer 40 to the ECU 50. In turn, the ECU 50 can communicate an electric signal to a plurality of electric solenoid activated fuel injectors 110 to optimally regulate the amount of fuel being injected into the combustion chambers of the engine. As represented by phantom arrows 111 in FIG. 7, it should be recognized that any number of inputs or variables may be communicated to the ECU 50 to make further adjustments, and to more optimally regulate the performance of the engine, for example and without limitation, the operating environment within a fuel tank (not shown).

As a safety mechanism, to prevent the first and second plates 12, 14 from remaining in an unintended open position (correlating to increased engine speed), the springs 84 yieldably bias the first plate 12 toward its first position, as shown in FIG. 4. It should be recognized that although the springs 84 bias the first plate 12 toward its first position, an operator of the vehicle may overcome the spring bias force by moving the throttle lever which applies a force to the first plate 12 via the throttle cable 18. Accordingly, when the operator releases the force from the throttle cable 18, such as by moving the throttle lever toward its idle position, the first plate 12, and thus the second plate 14 will be moved back to their first positions by the force of the springs 84.

The opening 109 is not obstructed by things like a valve head or valve shaft such as occurs with use of a butterfly-type throttle valve. Air may freely flow through the opening 109 at a rate determined at least in part by the effective size of flow area of the opening 109. It should also be recognized that when the first and second plates 12, 14 are in their second positions or wide open positions, the size of the opening 109 may be equal to or greater than the passage 24 within the housing 16 such that the passage 24 may limit the maximum air flow through the throttle body 10. To enable adjustment of the idle or first position of the plates 12, 14, a stop member 54 may be provided to engage one of the plates 12, 14 and establish the first position of that plate, and correspondingly, of the other plate as well (since they are coupled together by the pinion gears 92 and racks 94, 108). Desirably, the side wall 32 of the housing 16 has an opening 52 that is preferably threaded for receiving a threaded stop member, such as an adjustable stop screw 54. The adjustable screw 54 preferably has a generally conical tip 56 that can be moved relative to the second plate 14 to vary the location of the engagement of the second plate 14 and the tip 56. This permits the size of the opening 109, when the first and second plates 12, 14 are in their first position, to be varied and adjusted for stable idle engine operation.

The throttle body 10, and particularly the housing 16, the first and second plates 12, 14, the pinion gears 92, and the funnel portion 68 are preferably constructed from plastic, and therefore, are lightweight and of economical manufacture, design and assembly. It should be recognized that other materials, for example and without limitation, metallic materials, such as aluminum may be used in the construction of the separate components of the throttle body 10. Desirably, a relative large flow area opening can be provided with relatively little movement of the plates, with a generally completely circular opening formed when each plate moves one-half of the diameter of the circular opening. The size of the opening can also be quickly changed providing a responsive throttle body for improved engine control and performance.

While the forms of the invention herein disclosed constitute presently preferred embodiments, many others are possible. It is not intended herein to mention all of the possible equivalent forms or modifications of the invention. It is further understood that the terms used herein are merely descriptive rather than limiting, and various changes may be made without departing from the spirit or scope of this invention as defined by the following claims.

We claim:

1. A throttle body for an internal combustion engine, with a throttle member having at least a portion that is movable to control at least in part the operation of the engine, the throttle body comprising:

a housing having a passage through which all of the air is delivered through the throttle body;

a first plate carried by the housing for linear reciprocation between a first position and a second position in response to movement of the throttle member, and having a recess defining an arcuate leading edge; and a second plate carried by the housing for linear reciprocation between a first position and a second position in response to movement of the first plate, and having a recess defining an arcuate leading edge that is opposed to and facing the leading edge of the first plate so that the first plate and the second plate define an opening between them that has a minimum flow area when the first plate and the second plate are in their first positions, a larger flow area when the first plate and the second plate are in their second positions and wherein the flow area defined by the opening is unobstructed.

2. The throttle body of claim 1 further comprising a pinion having an axis of rotation, the pinion operably connecting together the first and second plates and being supported for rotation about the axis between at least a portion of the first and second plates.

3. The throttle body of claim 2 wherein the first plate has a surface with a toothed rack and the second plate has a surface with a toothed rack and the pinion is a gear having teeth for mating engagement with the toothed racks.

4. The throttle body of claim 3 wherein the rack of the first plate engages the pinion at a generally diametrically opposed location from where the rack of the second plate engages the pinion.

5. The throttle body of claim 4 wherein the second plate moves generally away from the first plate when the first plate is moving away from its first position and the second plate moves generally toward the first plate when the first plate is moving toward its first position.

6. The throttle body of claim 2 wherein the pinion rotates about its axis of rotation in one direction in response to the first plate moving away from its first position and the pinion rotates about its axis of rotation in another direction in response to the first plate moving toward its first position.

7. The throttle body of claim 1 wherein the first plate has a generally arcuate leading edge and the second plate has a generally arcuate leading edge such the leading edges define at least in part the opening.

8. The throttle body of claim 1 further comprising a spring yieldably biasing at least one of the plates toward its first position.

9. The throttle body of claim 8 wherein the first plate has a pocket for receiving at least part of the spring.

10. The throttle body of claim 8 wherein the spring is compressed between a surface of the housing and a surface of the first plate.

11. The throttle body of claim 8 wherein the biasing force applied to the first plate can be overcome by a force being applied to the throttle member.

12. A throttle body for an internal combustion engine, with a throttle member having at least a portion that is movable to control at least in part the operation of the engine, the throttle body comprising:

a housing having a passage;

a first plate carried by the housing for linear reciprocation between a first position and a second position in response to movement of the throttle member, a second plate carried by the housing for linear reciprocation between a first position and a second position in response to movement of the first plate, the first plate and the second plate define an opening between them that has a minimum flow area when the first plate and the second plate are in their first positions and a larger flow area when the first plate and the second plate are in their second positions; and a sensor communicating with at least one of the first and second plates for detecting the position of said at least one of the first and second plates.

13. The throttle body of claim 12 wherein the sensor is attached at least in part to at least one of the first and second plates for movement with said at least one of the first and second plates.

14. The throttle body of claim 13 wherein the sensor is attached at least in part to the housing.

15. The throttle body of claim 12 wherein the sensor is a linear potentiometer, and has a static portion carried by the housing and a slidable portion carried by one of the first and second plates.

16. The throttle body of claim 1 wherein the housing is constructed at least in part from plastic.

17. The throttle body of claim 1 wherein at least one of the first and second plates are constructed from plastic.

18. The throttle body of claim 1 wherein the housing has a generally cylindrical snout extending outwardly therefrom facilitating attachment of the throttle body to the internal combustion engine with a hose.

19. The throttle body of claim 1 wherein the housing has a flange portion facilitating attachment of the throttle body to the internal combustion engine with a plurality of fasteners.

20. The throttle body of claim 1 wherein the opening is unobstructed to provide an optimal flow area through the throttle body.

* * * * *